US005266439A

United States Patent [19]

Sacripante et al.

[11] Patent Number: 5,266,439

[45] Date of Patent: Nov. 30, 1993

[54] TONER PROCESSES

[75] Inventors: Guerino G. Sacripante, Oakville; Michael K. Georges, Guelph, both of Canada

[73] Assignee: Xerox Corporation, Stamford, Conn.

[21] Appl. No.: 871,152

[22] Filed: Apr. 20, 1992

[51] Int. Cl.[5] ..... G03G 9/087

[52] U.S. Cl. ..... 430/137

[58] Field of Search ..... 430/137; 526/340, 340.1

[56] References Cited

U.S. PATENT DOCUMENTS

| | | | |
|---|---|---|---|
| 4,465,756 | 8/1984 | Mikami et al. | 430/138 |
| 4,558,108 | 12/1985 | Alexandru et al. | 526/340 |
| 4,592,990 | 6/1986 | Takagi et al. | 430/137 |
| 4,727,011 | 2/1988 | Mahabadi et al. | 430/138 |
| 4,789,617 | 12/1988 | Arahara et al. | 430/137 |
| 4,797,339 | 1/1989 | Maruyama et al. | 430/109 |
| 4,816,366 | 3/1989 | Hyosu et al. | 430/137 |
| 4,937,167 | 6/1990 | Moffat et al. | 430/137 |
| 4,954,412 | 9/1990 | Breton et al. | 430/137 |
| 4,983,488 | 8/1991 | Tan et al. | 430/137 |
| 4,996,127 | 2/1991 | Hasegawa et al. | 430/109 |
| 5,089,295 | 2/1992 | McNeil | 430/137 |
| 5,139,915 | 8/1992 | Moffat et al. | 430/137 |

*Primary Examiner*—John Goodrow
*Attorney, Agent, or Firm*—E. O. Palazzo

[57] ABSTRACT

A process for the preparation of toner compositions which comprises mixing a monomer or plurality of monomers, pigment and optional charge control additive; dispersing the resulting mixture in an aqueous surfactant medium to provide microdroplets of a geometric size distribution of from about 1.4 to about 1.7; adding a second monomer whereby the second monomer is absorbed by the microdroplets such that the geometric size distribution thereof is reduced to from between about 1.2 to about 1.0; effecting polymerization of the resulting mixture and separating the toner comprised of a core polymer resin, pigment, optional charge control additive and a polymer thereover.

25 Claims, No Drawings

TONER PROCESSES

BACKGROUND OF THE INVENTION

This invention is generally directed to toner and developer compositions, and more specifically, the present invention is directed to processes for the preparation of toner compositions. In one embodiment, there are provided in accordance with the present invention in situ processes for the preparation of toner compositions with average volume particle sizes equal to, or less than about 12 microns in embodiments, and excellent narrow geometric size distribution (GSD) characteristics, such as in the range of from about 1.2 to about 1.4 in embodiments without resorting to classification. In embodiments, the process of the present invention comprises microdroplet swelling and wherein, for example, a second monomer is added to a microdroplet containing a monomer or monomers, pigment and optionally a charge controlling agent prior to polymerization thereof. In embodiments thereof, the processes of the present invention comprise dispersing an organic phase comprised of a monomer or plurality of monomers, pigment, and optionally a charge controlling agent in an aqueous medium containing a surfactant, such as hydroxyethyl cellulose, and thereby generating organic microdroplets of average volume particle sizes of about 5 microns to about 15 microns and GSDs of from about 1.4 to about 1.7; thereafter adding a second monomer which is preferably a gas at ambient temperature, such as butadiene, and whereby the said second monomer swells or is absorbed by the microdroplets such that a narrowing of geometric size distribution results such as from about 1.2 to about 1.4; followed by polymerization of the monomers by heat and separating the toner by washing and drying. With the process of this invention, encapsulated toners comprised of a core resin, colorant, optionally a charge control agent and a shell thereover comprised of a polyurea, a polyester, a cellulose coating and the like can be prepared with high yields, such as from about 90 percent to about 100 percent, and wherein average volume particle sizes of less than about 10 microns and excellent narrow geometric size distribution (GSD) characteristics, such as from about 1.2 to about 1.4 are obtained without classification. The toner and developer compositions of the present invention can be selected for electrophotographic, especially xerographic imaging and printing processes, including color processes.

In reprographic technologies, such as xerographic and ionographic devices, toners with small average volume diameter particle sizes of from about 5 microns to about 20 microns are utilized. Moreover, in some xerographic machines, such as the high volume Xerox Corporation 5090 printers, high resolution characteristics and low image noise can be attained utilizing small sized toners with average volume particle of less than 11 microns and preferably less than about 7 microns and with a narrow geometric size distribution of less than about 1.4 and preferably less than about 1.3. The volume average particle size is the 50 percent value of the volume distribution curve, and the geometric size distribution is reported as the square root of the 84 percent volume particle size divided by the 15 percent volume particle size. Generally, it is observed that toners with broad GSDs, such as from about 1.5 to about 1.7 or more, can result in reduced image quality such as low resolution and high image noises, whereas toners with narrow GSDs, such as less than 1.4 and preferably less than 1.3, can result in superior copy quality with high resolution and low undesirable image noises, that is for example minimal or no background deposits, excellent line resolution with minimal or no image deterioration, or background deposits.

Numerous processes are known for the preparation of toners, such as for example conventional processes wherein a resin is melt kneaded or extruded with a pigment, micronized and pulverized to provide toner particles with an average volume particle diameter of from about 7 microns to about 20 microns and with a broad geometric size distribution of from about 1.4 to about 1.7. In such processes, it is usually necessary to subject the aforementioned toners to a classification procedure such that the geometric size distribution of from about 1.2 to about 1.4 are attained. However, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9, and preferably 7 microns with excellent GSDs of from about 1.2 to about 1.4 are attained without resorting to classification processes, and wherein high toner yields are attained such as from about 90 percent to about 98 percent. Additionally, other processes such as suspension polymerization, or semisuspension and the like, are known, wherein the toners are obtained by dispersion of an organic mixture in an aqueous surfactant solution and thereafter polymerized by heating to yield encapsulated toners of average particle diameter of from between about 5 to about 20 microns and a geometric size distribution of from about 1.33 to about 1.7 after classification. With the processes of the present invention, in embodiments a second monomer, which is preferably a gas at ambient temperature such as butadiene, is added to a microdroplet suspension prior to polymerization. It is believed that during this process step the smaller microdroplet particles absorb the second monomer at a faster rate than the larger particles present due to the greater surface area of the smaller particles, hence resulting in a narrowing of geometric size distribution such as from about 1.2 to about 1.4. Processes are also known wherein particles are prepared by solvent dispersion processes providing monodispersed GSDs such as from about 1.01 to 1.13. However, such processes are limited to selected monomers, employ undesirable organic solvents and are difficult to pigment or dye.

More specifically, the processes of the present invention involves (i) mixing a core resin forming monomer(s) such styrene and n-butyl acrylate, a colorant such as HELIOGEN BLUE TM, a free radical initiator such as VAZO 67 TM, and optionally a charge control agent such as chromium salicylate; (ii) dispersing this mixture using a high shearing device such as a Brinkmann 45G probe operating at from about 8,000 to about 10,000 rpm for a duration of from about 30 to about 120 seconds, in a vessel containing an aqueous solution of a surfactant such as TYLOSE ® and optionally an ionic surfactant such as sodium dodecylsulfate and generating a microdroplet suspension of an average volume particle size of from about 3 to about 15 microns with GSD's of about 1.4 to about 1.7; (iii) adding a second monomer such as butadiene such that the said second monomer swells or is absorbed by the smaller microdroplet particle at a faster rate than the larger microdroplet particles resulting in the narrowing of geometric size distribution to less than 1.4 and preferably less than about 1.3; (iv) heating the mixture to effect free radical core polymer formation at from about 60° C. to about 120° C. for a duration of from about 360 minutes to about 720 minutes; and (v) washing the toner product by centrifugation from about 4 to about 6 times, and drying using preferably a fluidized bed, operated at from about 30° C. to about 60° C. for a duration of from about 240 minutes to about 480 minutes. Additives to improve flow characteristics may be optionally added to the toner such as AEROSIL ® or silicas and the like in an amount of from about 0.1 to about 10 percent by weight of the toner.

Encapsulated toners and processes thereof are known; for example, there are disclosed in both U.S. Pat. Nos. 4,338,390 and 4,298,672, the disclosures of which are totally incorporated herein by reference, positively charged toner compositions with resin particles and pigment particles, and as charge enhancing additives alkyl pyridinium compounds. Moreover, toner compositions with negative charge enhancing additives are known, reference for example U.S. Pat. Nos. 4,411,974 and 4,206,064, the disclosures of which are totally incorporated herein by reference. Additionally, other documents disclosing toner compositions with charge control additives include U.S. Pat. Nos. 3,944,493; 4,007,293; 4,079,014 4,394,430, and 4,560,635 which illustrates a toner with a distearyl dimethyl ammonium methyl sulfate charge additive. These toners may be prepared, for example, by the usual known jetting, micronization, and classification processes. Toners obtained with these processes generally possess a toner volume average diameter of from between about 10 to about 20 microns and the GSDs of these toners are usually from about 1.3 to about 1.45 after classification and are believed to be obtained in yields of from about 70 percent to about 85 percent by weight. The toners obtained with the processes of the present invention in embodiments are prepared by monomer swelling processes, and alleviate the need for classification and results in average particles sizes of about 3 to about 15 microns with GSDs of about 1.2 to about 1.4 with high toner yields of, for example, 90 percent to about 99.5 percent by weight.

Moreover, encapsulated toner compositions and process are also known, as illustrated for example in U.S. Pat. No. 4,954,412, the disclosure of which is totally incorporated herein by reference, and which illustrates a suspension process for an encapsulated toner comprised of core resin, a pigment and a shell comprised of a polyester, see Example 1, column 16 line 11, and similarly Examples 2 through Example 10, wherein the GSD is reported to be from about 1.31 to about 1.62. Similarly, U.S. Pat. No. 4,937,167 discloses a suspension process for an encapsulated toner comprised of a core material comprising a resin, colorant and a shell comprising a polyurea, see Examples 1 through Examples 9, wherein the GSD is reported to be from about 1.4 to about 1.62. Additionally, U.S. Pat. No. 5,223,370, the disclosure of which is totally incorporated herein by reference, discloses an in situ suspension process for a toner comprised of a core comprised of a resin, pigment and optionally charge control agent and coated thereover with a cellulosic material, and wherein the GSDs are reported to be from about 1.32 to about 1.45. The process for the encapsulated toners of the present invention differs from these processes in that, for example, during the suspension process, a second monomer is swelled into the microdroplet prior to polymerization, thus effecting a narrowing of the GSD, which can be caused by the larger surface area of the smaller particles, hence a growth in particle sizes of the smaller particles and narrowing of GSD of from about 1.2 to about 1.4 and preferably less than 1.3. Similarly, U.S. Pat. Nos. 4,789,617; 4,601,968; 4,592,990; 4,904,562; 4,465,756; 4,468,446; 4,533,616; 4,565,763 and 4,592,990 also disclose suspension processes for the preparation of encapsulated toners with GSDs usually above 1.35 to about 1.6. Other prior art encapsulated toners include pressure fixable encapsulated toners and processes, reference U.S. Pat. Nos. 4,803,142; 4,656,111; 4,517,273; 4,543,312; 4,609,607; 4,784,930; 4,307,169; 4,617,249 and 4,702,989.

There is a need for black or colored toners wherein small particle sizes of less than or equal to 10 microns in volume diameter and narrow geometric size distribution of less than 1.4 and preferably less than 1.3 are obtained. Furthermore, there is a need for colored toner processes wherein the toner synthetic yields are high, such as from about 90 percent to about 100 percent, without resorting to classification procedures. In addition, there is a need for black and colored toners that are nonblocking, enable excellent image resolution, are nonsmearing, and of excellent triboelectric charging characteristics.

SUMMARY OF THE INVENTION

It is an object of the present invention to provide toners with many of the advantages illustrated herein.

In another object of the present invention there are provided processes for the preparation of toner compositions wherein micronizing, jetting, and classification can be avoided in embodiments.

In yet another object of the present invention there are provided toner compositions with narrow GSDs.

In yet another object of the present invention there are provided toner compositions obtained by monomer swelling or absorption.

In another object of the present invention there are provided processes for encapsulated toner compositions in high yields without classification.

Another object of the present invention resides in providing processes for toner compositions by monomer swelling and wherein the resulting toners possess an average volume diameter of from between about 3 to 15, and preferably from between about 3 to about 7 microns.

Also, in another object of the present invention there are provided developer compositions with toner particles obtained by the monomer swelling processes illustrated herein, carrier particles, and optional enhancing additives or mixtures of these additives.

Another object of the present invention resides in the formation of toners which will enable the development of images in electrophotographic imaging and printing apparatuses, which images have substantially no background deposits thereon, and are of excellent resolution, which toner compositions can be selected for high speed electrophotographic apparatuses, that is those exceeding 70 copies per minute.

In embodiments, the present invention is directed to processes for the preparation of toner compositions comprised, for example, of resin particles, pigment particles, and optional known charge enhancing additives comprised of, for example, chromium salicylates, quaternary ammonium hydrogen bisulfates, tera alkyl ammonium sulfonates and the like. More specifically, the present invention in embodiments is directed to processes for the preparation of encapsulated toner compositions containing dispersing a monomer, or plurality of monomers and pigment in a reaction vessel comprised of an aqueous solution of a known surfactant, such as an alkyl cellulose like hydroxyethylmethyl cellulose, methylethyl cellulose, polyvinyl alcohol, and the like; adding a second organic monomer or plurality, up to 10 for example, of monomers whereby the second monomer is absorbed or swelled by the organic microdroplet comprised of first monomer and pigment, wherein the GSD of the microdroplets narrows due to the faster absorption of the small microdroplet sized particles as compared to the larger microdroplets formed; and effecting a free radical polymerization of the aforementioned mixture by heating followed by cooling; thereby resulting in a toner comprised of a polymer and pigment with a coating such as cellulose thereover. In embodiments, the toner obtained has a GSD as measured by the Coulter Counter of from between 1.2 to about 1.4 and preferably below 1.3. Also, in embodiments the toners are obtained without micronization and classification and have an average particle volume diameter of from between about 3 to about 9, and preferably about 7 microns. Absorption of the second monomer, or monomer swelling, can be controlled by slowly adding the second monomer for a duration of from about 15 minutes to about 240 minutes. In embodiments, there can be obtained by microsuspension in situ suspension processes toners with narrower GSDs by the addition thereto of a second monomer to said suspension, which monomer is gaseous at ambient temperature of about 25° C., such as butadiene, or a liquid such as myrecin or isoprene, or a liquid such as 2-hydroxyethyl methacrylate, acrylic acid, or methacrylic acid which are water soluble and also soluble in the organic microdroplets comprised of the first monomer or monomers and pigment.

In embodiments, an encapsulated toner composition can be prepared by a simple one-pot process involving formation of a stabilized particle suspension, addition of a second monomer swelled or absorbed by the particle suspension, followed by a core resin forming free radical polymerization within the particles. The process is comprised of, for example, (1) thoroughly mixing or blending core resin monomer or monomers, optional preformed core resins, free radical initiators, and colorants; (2) dispersing the aforementioned well blended mixture by high shear blending to form stabilized microdroplets of a specific droplet size and geometric size distribution of from about 1.4 to about 1.7 in an aqueous mixture containing a suitable cellulose polymer, such as TYLOSE ®, and an optional inorganic surfactant; (3) adding a second monomer to the formed particle suspension and wherein the second monomer is swelled or absorbed by the microdroplet suspension thus effecting a narrowing of the GSD of from about 1.2 to about 1.4 as inferred from a Coulter Counter; (4) effecting free radical polymerization by heating to form the core resin; (5) and separating the resulting toner particles by washing, and drying by known methods such spray drying or fluidized bed drying. The formation of the stabilized particle suspension is generally conducted at ambient temperature, about 25° C., in embodiments, while the free radical polymerization is accomplished at a temperature of from about 35° C. to about 120° C., and preferably from about 45° C. to about 90° C., for a period of from about 1 to about 24 hours depending primarily on the monomers and free radical initiators used. The toner comprised of a core resin obtained via free radical polymerization of the first and second monomers, together with the optional preformed polymer resin, comprises from about 75 to about 97 percent, and preferably from about 85 to about 95 percent by weight of the toner, the colorant comprises from about 1 to about 15 percent by weight of the toner, and the coating, such as cellulose, comprises from about 0.001 to about 2 percent by weight of the toner.

Illustrative examples of the first free radical monomers include a number of known components such as acrylates, methacrylates, olefins including styrene and its derivatives such as methyl styrene, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, acrylic acid, methacrylic acid, vinyl chloride, vinylidene chloride, styrene, substituted styrenes, other substantially equivalent addition monomers, and known addition monomers, reference for example U.S. Pat. No. 4,298,672, the disclosure of which is totally incorporated herein by reference, and mixtures thereof. Illustrative examples of optional preformed core resins include styrene polymers, such as styrene-butadiene copolymers, PLIOLITES ®, PLIOTONES ®, polyesters, acrylate and methacrylate polymers, and the like.

Various known colorants may be selected for the processes and toner compositions providing, for example, that they do not substantially interfere with the free radical polymerization. Typical examples of specific colorants, preferably present in an effective amount of, for example, from about 3 to about 10 weight percent of the toner include PALIOGEN VIOLET 5100 TM and 5890 TM (BASF), NORMANDY MAGENTA RD-2400 TM (Paul Uhlich), PERMANENT VIOLET VT2645 TM (Paul Uhlich), HELIOGEN GREEN L8730 TM (BASF), ARGYLE GREEN XP-111-S TM (Paul Uhlich), BRILLIANT GREEN TONER GR 0991 TM (Paul Uhlich), LITHOL SCARLET D3700 TM (BASF), TOLUIDINE RED TM (Aldrich), SCARLET for THERMOPLAST NSD RED TM (Aldrich), LITHOL RUBINE TONER TM (Paul Uhlich), LITHOL SCARLET 4440 TM, NBD 3700 TM (BASF), BON RED C TM (Dominion Color), ROYAL BRILLIANT RED RD-8192 TM (Paul Uhlich), ORA- CET PINK RF TM (Ciba Geigy), PALIOGEN RED 3340 TM and 3871K TM (BASF), LITHOL FAST SCARLET L4300 TM (BASF), HELIOGEN BLUE D6840 TM, D7080 TM, K7090 TM, K6902 TM, K6910 TM and L7020 TM (BASF), SUDAN BLUE OS TM (BASF), NEOPEN BLUE FF4012 TM (BASF), PV FAST BLUE B2G01 TM (American Hoechst), IRGALITE BLUE BCA TM (Ciba Geigy), PALIOGEN BLUE 6470 TM (BASF), SUDAN II TM, III TM and IV TM (Matheson, Coleman, Bell), SUDAN ORANGE TM (Aldrich), SUDAN ORANGE 220 TM (BASF), PALIOGEN ORANGE 3040 TM (BASF), ORTHO ORANGE OR 2673 TM (Paul Uhlich), PALIOGEN YELLOW 152 TM and 1560 TM (BASF), LITHOL FAST YELLOW 0991K TM (BASF), PALIOTOL YELLOW 1840 TM (BASF), NOVAPERM YELLOW FGL TM (Hoechst), PERMANENT YELLOW YE 0305 TM (Paul Uhlich), LUMOGEN YELLOW D0790 TM (BASF), SUCO-GELB L1250 TM (BASF), SUCO-YELLOW D1355 TM (BASF), SICO FAST YELLOW D1165 TM, D1355 TM and D1351 TM (BASF), HOSTAPERM PINK E TM (Hoechst), FANAL PINK D4830 TM (BASF), CINQUASIA MAGENTA TM (DuPont), PALIOGEN BLACK L0084 TM (BASF), PIGMENT BLACK K801 TM (BASF) and carbon blacks such as REGAL 330® (Cabot), CARBON BLACK 5250 TM and 5750 TM (Columbian Chemicals), and the like.

Examples of surfactants selected for the toners and processes of the present invention include, alkyl celluloses, with the alkyl groups containing, for example, from 1 to about 12 carbon atoms; and more specifically methyl cellulose, ethyl cellulose, hydroxyethyl cellulose, hydroxypropyl cellulose, hydroxyethylmethyl cellulose, TYLOSE® and the like. The effective concentration of the cellulose polymer in the aqueous phase at the dispersion or microdroplet formation step is, for example, from about 0.1 percent by weight to about 5 percent by weight, with the preferred amount being determined primarily by the nature of the toner precursor materials and the desired toner particle size. In embodiments, inorganic surfactants are also utilized in combination with the cellulose polymer for achieving a smaller microdroplet size. Illustrative examples of suitable inorganic surfactants include alkali salts, such as potassium oleate, potassium caprate, potassium stearate, sodium laurate, sodium dodecyl sulfate, sodium oleate, sodium laurate, and the like. The effective concentration of inorganic surfactant that is generally employed is, for example, from about 0.005 to about 0.5 percent by weight, and preferably from about 0.01 to about 0.10 percent by weight.

Illustrative examples of known free radical initiators that can be selected for the preparation of the toners include azo-type initiators such as 2-2'-azobis(dimethylvaleronitrile), azobis(isobutyronitrile), azobis(cyclohexane-nitrile), azobis(methyl-butyronitrile), mixtures thereof, and the like, peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, mixtures thereof such as mixtures of potassium persulfate and sodium bisulfite with the effective quantity of initiator being, for example, from about 0.1 percent to about 10 percent by weight of that of the core monomer or core monomers.

Examples of the second monomer or monomers utilized in the swelling or absorption onto the microdroplet suspension, include butadiene, isoprene, mycerin, 2-hydroxyethyl methacrylate, 2-hydroxyethyl acrylate, 2-hydroxyethyl methacrylate, 2-hydroxyethyl acrylate, 2-hydroxypropyl methacrylate, 2-hydroxypropyl acrylate, acrylic acid, methacrylic acid, styrene, styrene sulfonic acid, methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, mixtures thereof and the like with the effective quantity being, for example, from about 1 percent to about 50 percent by weight of the toner.

In one embodiment, the encapsulated situ toner composition can be prepared by (i) mixing a core resin forming monomer such as styrene from about 0.4 mole to 0.6 mole, n-butyl acrylate from about 0.1 mole to about 0.2 mole, a colorant, such as HELIOGEN BLUE TM, from about 0.01 mole to about 0.015 mole, a free radical initiator, such as VAZO 67 TM, from about 0.001 mole to about 0.003 mole; (ii) dispersing this mixture using a high shearing device, such as a Brinkmann 45G probe, operating at a speed at from about 8,000 to about 10,000 rpm for a duration of from about 30 to about 120 seconds in a vessel containing from about a 0.5 liter to about 0.75 liter of water having dissolved therein a cellulose surfactant, such as TYLOSE®, from about 0.75 to about 1 percent by weight of water, and an ionic surfactant such as sodium dodecylsulfate from about 0 to 0.04 percent by weight of water, thus generating a microdroplet suspension of a volume average particle size of from about 5 microns to about 7 microns with a GSD of from about 1.45 to about 1.60 as measured by a Coulter Counter; (iii) adding thereto a second monomer, such as 2-hydroxyethyl methacrylate, from about 0.2 mole to 0.4 mole, for a duration of from about 15 minutes to about 60 minutes, and hence narrowing the GSD to from about 1.2 to 1.4 as measured by a Coulter Counter; (iv) heating the mixture from about 60° C. to about 95° C. and for a duration of from about 360 minutes to about 720 minutes to effect free radical core polymer formation; and (v) separating the toner product by washing with centrifugation from about four to about six times, followed by drying using preferably a fluidized bed, operated of from about 30° C. to about 60° C. for a duration of from about 240 minutes to about 480 minutes. The toner is comprised of a core resin from about 90 percent to about 95 percent, the colorant constitutes from about 2 percent to about 7 by weight of the toner, and the cellulose coating constitutes from about 0.01 to about 1 percent by weight of the toner.

The following Examples are being submitted to further illustrate various embodiments of the present invention. These Examples are intended to be illustrative only and are not intended to limit the scope of the present invention. A Comparative Example is also provided.

COMPARATIVE EXAMPLE I

A cyan in situ toner with a 12 micron volume average particle diameter, a 1.51 geometric size distribution, and comprised of a styrene-acrylate-methacrylate core, HELIOGEN BLUE TM pigment, and hydroxyethylmethyl cellulose coating was prepared as follows.

A mixture of 126 grams of styrene, 50 grams of 2-hydroxyethyl methacrylate, 24 grams of n-butyl acrylate, and 7 grams of HELIOGEN BLUE TM (obtained from BASF) pigment was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. The resulting mixture was transferred to a 2 liter reaction vessel containing 700 milliliters of a 0.75 percent aqueous TYLOSE ® solution and the resulting mixture was homogenized for 2 minutes using a Brinkmann polytron operating at 7,000 rpm. Thereafter, the resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed dryer operated at ambient temperature to about 40° C. The in situ toner comprised of about 96 percent of poly(styrene-butyl acrylate-2-hydroxyethyl methacrylate) core resin, about 3.5 percent of the HELIOGEN BLUE TM pigment, and about 0.01 to about 0.5 percent of cellulose shell coating, evidenced a volume average particle diameter of 12 microns, and a particle size distribution of 1.51, according to Coulter Counter measurements.

A charged developer was prepared by blending 98 parts by weight of the above coated or encapsulated particles with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. Latent images were formed in a xerographic experimental imaging device similar to the Xerox Corporation 9200, and unacceptable images were obtained with the aforementioned developer, which images possessed low resolution characteristics and high image noises, that is the image clarity was reduced, line resolution was poor with some characters, and background deposits were present.

EXAMPLE I

A cyan in situ toner with a 15 micron volume average particle diameter, a 1.33 geometric size distribution, and comprised of a styrene-acrylate-methacrylate core, HELIOGEN BLUE TM pigment, and hydroxyethylmethyl cellulose coating was prepared as follows.

A mixture of 126 grams of styrene, 24 grams of n-butyl acrylate, and 7 grams of HELIOGEN BLUE TM (obtained from BASF) pigment was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. The resulting mixture was transferred to a 2-liter reaction vessel containing 700 milliliters of a 0.75 percent aqueous TYLOSE ® solution and the resulting mixture was homogenized for 2 minutes using a Brinkmann polytron operating at 7,000 rpm. Thereafter, 50 grams of 2-hydroxethyl methacrylate was added slowly over a duration of 30 minutes. The resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed drier operated at ambient temperature to about 40° C. The encapsulated toner comprised of about 96 percent of poly(styrene-butyl acrylate-2-hydroxyethyl methacrylate) core resin, about 3.5 percent of the above pigment, and about 0.01 to about 0.5 percent of cellulose coating evidenced a volume average particle diameter of 15 microns, and a particle size distribution of 1.33, according to Coulter Counter measurements. A difference between the process of Comparative Example I and this Example was that the second monomer, 2-hydroxyethyl methacrylate, was added after microsuspension and resulted in a narrowing of GSD from about 1.51 (Comparative Example I) to 1.33.

A charged developer was prepared by blending 98 parts by weight of the encapsulated particles obtained with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. Latent images were formed in a xerographic experimental imaging device similar to the Xerox Corporation 9200, and excellent images were obtained with the aforementioned developer, such as excellent resolution characteristics and low image noises with substantially no undesirable background deposits.

EXAMPLE II

A cyan in situ toner with a 9 micron volume average particle diameter, a 1.29 geometric size distribution, and comprised of a styrene-acrylate-methacrylate core, HELIOGEN BLUE TM pigment, and hydroxyethylmethyl cellulose coating was prepared as follows.

A mixture of 126 grams of styrene, 24 grams of n-butyl acrylate, and 7 grams of HELIOGEN BLUE TM (obtained from BASF) pigment was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. The resulting mixture was transferred to a 2 liter reaction vessel containing 700 milliliters of a 1.0 percent aqueous TYLOSE ® solution containing 0.01 percent by volume of sodium dodecylsulfate, and the resulting mixture was homogenized for 2 minutes using a Brinkmann polytron operating at 10,000 rpm. Thereafter, 50 grams of 2-hydroxethyl methacrylate was added slowly over a duration of 30 minutes. The resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed dryer operated at ambient temperature to about 40° C. The encapsulated toner, comprised of about 96 percent of poly(styrene-butyl acrylate-2-hydroxyethyl methacrylate) core resin, about 3.5 percent of the above pigment, and about 0.01 to about 0.5 percent of the above cellulose TYLOSE ® coating, evidenced a volume average particle diameter of 9 microns, and a particle size distribution of 1.29, according to Coulter Counter measurements.

A charged developer was prepared by blending 98 parts by weight of the encapsulated particles obtained with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. Latent images were formed in a xerographic experimental imaging device similar to the Xerox Corporation 9200, and excellent images were obtained with the aforementioned developer, such as excellent resolution characteristics and low image noises with substantially no undesirable background deposits.

EXAMPLE III

A cyan in situ toner with a 6.9 micron volume average particle diameter, a 1.27 geometric size distribution, and comprised of a styrene-acrylate-methacrylate core, HELIOGEN BLUE TM pigment, and hydroxyethylmethyl cellulose TYLOSE ® coating was prepared as follows.

A mixture of 106 grams of styrene, 24 grams of n-butyl acrylate, and 7 grams of HELIOGEN BLUE TM (obtained from BASF) pigment was ball milled for 24 hours. To this mixture were added 3.0 grams each of 2,2'-azobis-(2,4-dimethylvaleronitrile) and 2,2'-azobis-(isobutyronitrile), and the mixture was roll blended until all the aforementioned free radical initiators were dissolved. The resulting mixture was transferred to a 2 liter reaction vessel containing 700 milliliters of a 1.0 percent aqueous TYLOSE ® solution containing 0.02 percent by volume of sodium dodecylsulfate, and the resulting mixture was homogenized for 2 minutes using a Brinkmann polytron operating at 10,000 rpm. Thereafter, 70 grams of 2-hydroxethyl methacrylate was added slowly for a duration of 30 minutes. The resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed dryer operated at ambient temperature to about 40° C. The encapsulated toner, comprised of about 96 percent of poly(styrene-butyl acrylate-2-hydroxyethyl methacrylate) core resin or polymer, about 3.5 percent of the above pigment, and about 0.01 to about 0.5 percent of cellulose coating, evidenced a volume average particle diameter of 6.9 microns, and a particle size distribution of 1.27 according to Coulter Counter measurements.

A charged developer was prepared by blending 98 parts by weight of the encapsulated particles obtained with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. Latent images were formed in a xerographic experimental imaging device similar to the Xerox Corporation 9200, and excellent images were obtained with the aforementioned developer, such as excellent resolution characteristics and low image noise.

EXAMPLE IV

A magenta in situ toner with a 6.5 micron volume average particle diameter, a 1.29 geometric size distribution, and comprised of a styrene-acrylate-methacrylate core, HOSTAPERM PINK TM pigment, and hydroxyethylmethyl cellulose coating was prepared as follows.

A mixture of 52 grams of styrene, and 3.2 grams of HOSTAPERM BLUE TM (obtained from BASF) pigment was ball milled for 24 hours. To this mixture were added 3.0 grams each of 2,2'-azobis-(2,4-dimethylvaleronitrile) and 2,2'-azobis-(isobutyronitrile), and the mixture was roll blended until the aforementioned free radical initiators were dissolved. The resulting mixture was transferred to a 300 milliliter pressure reaction vessel containing 700 milliliters of a 1.0 percent aqueous TYLOSE ® solution containing 0.02 percent by volume of sodium dodecylsulfate, and the resulting mixture was homogenized for 2 minutes using a Brinkmann polytron operating at 10,000 rpm. Thereafter, 12 grams of butadiene was introduced into the reactor and the vessel pressurized to 60 pounds per square inch with nitrogen gas. The resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed dryer operated at ambient temperature to about 40° C. The encapsulated toner comprised of about 96 percent of poly(styrene-butadiene) core resin, about 5 percent of the above pigment, and about 0.01 to about 0.5 percent of the cellulose coating evidenced a volume average particle diameter of 6.5 microns, and a particle size distribution of 1.29 according to Coulter Counter measurements.

A charged developer was prepared by blending 98 parts by weight of the encapsulated particles obtained with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. Latent images were formed in a xerographic experimental imaging device similar to the Xerox Corporation 9200, and excellent images were obtained with the aforementioned developer, such as excellent resolution characteristics and low image noises, that is for example substantially no toner image background deposits.

EXAMPLE V

A magenta in situ toner with a 7.3 micron volume average particle diameter, a 1.30 geometric size distribution, and comprised of a styrene-butadiene core, HOSTAPERM PINK TM pigment, and hydroxyethylmethyl cellulose coating was prepared as follows.

A mixture of 52 grams of styrene, and 3.2 grams of HOSTAPERM BLUE TM (obtained from BASF) pigment was ball milled for 24 hours. To this mixture were added 1.5 grams each of 2,2'-azobis-(2,4-dimethylvaleronitrile) and 2,2'-azobis-(isobutyronitrile), and the mixture was roll blended until all the aforementioned free radical initiators were dissolved. The resulting mixture was transferred to a 1 liter pressure reaction vessel containing 150 milliliters of a 1.0 percent aqueous TYLOSE® solution containing 0.02 percent by volume of sodium dodecylsulfate, and the resulting mixture was homogenized for 2 minutes using a Brinkmann polytron operating at 10,000 rpm. Thereafter, 12 grams of butadiene was introduced into the reactor and the vessel pressurized to 60 pounds per square inch with nitrogen gas. The resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed dryer operated at ambient temperature to about 40° C. The coated toner comprised of about 96 percent of poly(styrene-butadiene) core resin, about 5 percent of the above pigment, and about 0.01 to about 0.5 percent of cellulose coating evidenced a volume average particle diameter of 7.3 microns, and a particle size distribution of 1.30 according to Coulter Counter measurements.

A charged developer was prepared by blending 98 parts by weight of the coated toner particles obtained with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. Latent images were formed in a xerographic experimental imaging device similar to the Xerox Corporation 9200, and excellent images were obtained with the aforementioned developer, such as excellent resolution characteristics and low image noises.

EXAMPLE VI

A magenta in situ toner with a 9 micron volume average particle diameter, a 1.26 geometric size distribution, and comprised of a styrene-acrylate-methacrylate core, HOSTAPERM PINK TM pigment, and hydroxyethylmethyl cellulose coating was prepared as follows.

A mixture of 52 grams of styrene, and 3.2 grams of HOSTAPERM BLUE TM (obtained from BASF) pigment was ball milled for 24 hours. To this mixture were added 1.5 grams each of 2,2'-azobis-(2,4-dimethylvaleronitrile) and 2,2'-azobis-(isobutyronitrile), and the mixture was roll blended until the aforementioned free radical initiators were dissolved. The resulting mixture was transferred to a 300 milliliter pressure reaction vessel containing 150 milliliters of a 1.0 percent aqueous TYLOSE® solution containing 0.02 percent by volume of sodium dodecylsulfate, and the resulting mixture was homogenized for 2 minutes using a Brinkmann polytron operating at 10,000 rpm. Thereafter, 12 grams of butadiene were introduced into the reactor and the vessel pressurized to 60 pounds per square inch with nitrogen gas. The resulting mixture was subsequently heated to 80° C. over a period of 1 hour, and retained at this temperature for another 10 hours before cooling it down to room temperature. The product was washed repeatedly with water until the aqueous phase was clear, and then freeze dried utilizing a fluid bed dryer operated at ambient temperature to about 40° C. The coated toner comprised of about 96 F percent of poly(styrene-butadiene) core resin, about 5 percent of the above pigment, and about 0.01 to about 0.5 percent of cellulose coating evidenced a volume average particle diameter of 9 microns, and a particle size distribution of 1.26 according to Coulter Counter measurements.

A charged developer was prepared by blending 98 parts by weight of the coated toner particles obtained with 2 parts by weight of Xerox Corporation 9200 carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. Latent images were formed in a xerographic experimental imaging device similar to the Xerox Corporation 9200, and excellent images were obtained with the aforementioned developer, such as excellent resolution characteristics and low image noises.

Other modifications of the present invention may occur to those skilled in the art subsequent to a review of the present application, and these modifications, including equivalents thereof, are intended to be included within the scope of the present invention.

What is claimed is:

1. An in situ process for the preparation of toner compositions consisting essentially of mixing a monomer or plurality of monomers, pigment and optional charge control additive; dispersing the resulting organic phase mixture in an aqueous surfactant medium to provide microdroplets of an average volume particle size of from about 5 microns to about 15 microns and a geometric size distribution of from about 1.4 to about 1.7; adding a second monomer whereby the second monomer swells or is absorbed by the microdroplets such that the geometric size distribution thereof is reduced to from between about 1.2 to about 1.4; effecting polymerization of the resulting mixture and separating the toner comprised of a core polymer resin, pigment, optional charge control additive and a polymer thereover.

2. An in situ process for the preparation of toner compositions consisting essentially of providing a monomer and pigment; adding thereto a second monomer whereby the second monomer swells or is absorbed by the first monomer; effecting polymerization by heating the mixture resulting; cooling the toner product obtained; separating the toner with a geometric size distribution of from between 1.2 to about 1.4 and a volume average particle diameter of from between about 3 to about 10 microns.

3. A process in accordance with claim 2 wherein the first monomer is styrene, alkyl acrylate, alkyl methacrylate or mixtures thereof.

4. A process in accordance with claim 1 wherein the second monomer is butadiene, or 2-hydroxyethyl methacrylate.

5. A process in accordance with claim 2 wherein the second monomer is butadiene, isoprene, myrecin, 2-hydroxyethyl methacrylate, 2-hydroxyethyl acrylate, hydroxypropyl acrylate, 2-hydroxy propyl acrylate, methyl acrylate, ethyl acrylate, propyl acrylate, butyl acrylate, hexyl acrylate, octyl acrylate, dodecyl acrylate, lauryl acrylate, stearyl acrylate, methyl methacrylate, ethyl methacrylate, propyl methacrylate, butyl methacrylate, hexyl methacrylate, octyl methacrylate, dodecyl methacrylate, lauryl methacrylate, stearyl methacrylate, styrene, styrene sulfonic acid, acrylic acid, methacrylic acid, or mixtures thereof.

6. A process in accordance with claim 2 wherein the second monomer is absorbed on the first monomer over a period of time of from about 1 minute to about 360 minutes.

7. A process in accordance with claim 1 wherein the first monomer is present in a range amount of from about 0.2 mole percent to about 0.95 mole percent.

8. A process in accordance with claim 2 wherein the second monomer is present in a range amount of from about 0.2 mole percent to about 0.95 mole percent.

9. A process in accordance with claim 2 wherein the polymerization heating temperature is in the range of from about 60° C. to about 120° C.

10. A process in accordance with claim 1 wherein the toner average volume diameter is in the range of from about 3 to about 11 microns.

11. A process in accordance with claim 2 wherein the toner polymer is a styrene acrylate, a styrene methacrylate, or a styrene butadiene.

12. A process in accordance with claim 2 wherein the pigment is carbon black, or cyan, magenta, yellow, red, green, blue, brown or mixtures thereof.

13. A process for the preparation of toner compositions without micronization and without classification which process consists essentially of dispersing a mixture of monomers, an optional preformed polymer resin, a free radical initiator, and a colorant comprised of a pigment, dye or mixtures thereof to form a stable organic phase microdroplet suspension in an aqueous mixture containing a cellulose polymer surfactant, and an optional inorganic surfactant; adding thereto a second monomer which monomer is swelled or absorbed by the stable microdroplet; initiating core resin-forming free radical polymerization by heating; and separating the toner by washing and drying; and wherein the toner has a geometric size distribution of from between about 1.2 to about 1.4, and the volume average particle diameter of said toner is from between about 3.0 to about 10.0 microns.

14. A process in accordance with claim 1 wherein the resulting mixture is dispersed in the aqueous surfactant medium by a shearing device.

15. A process in accordance with claim 1 wherein the polymer thereover is a polyester, a polyurea, a polyurethane, a polyamide, or a polycarbonate.

16. A process in accordance with claim 1 wherein the polymer thereover is comprised of a coating of cellulose, methylethyl cellulose, hydroxyethyl cellulose, polyvinyl alcohol, or polyacrylic acid.

17. An in situ process for the preparation of encapsulated toners consisting essentially of mixing a monomer, or mixture of monomers and pigment; dispersing the organic phase mixture resulting in an aqueous surfactant medium to provide microdroplets therein; adding a second monomer or monomers which are swelled or absorbed by the microdroplets; polymerizing the mixture resulting and separating therefrom toner comprised of a core polymer, pigment and a polymeric shell thereover; and wherein the organic phase microdroplets have an average volume particle diameter of from about 5 microns to about 15 microns, and a geometric size distribution of from about 1.4 to about 1.7; and said toner has a geometric size distribution of from between about 1.2 to about 1.4.

18. A process in accordance with claim 1 wherein the surfactant is alkyl cellulose.

19. A process in accordance with claim 2 wherein the surfactant is alkyl cellulose.

20. A process in accordance with claim 1 wherein the surfactant is hydroxyethyl cellulose.

21. A process in accordance with claim 2 wherein the surfactant is hydroxyethyl cellulose.

22. A process in accordance with claim 2 wherein there is added to the organic phase free radical initiators.

23. A process in accordance with claim 22 wherein the free radical initiators are comprised of a mixture of 2,2'-azobis-(2,4-dimethylvaleronitrile) and 2,2'-azobis-(isobutyronitrile).

24. A process in accordance with claim 2 wherein there results a cyan toner with a 15 micron volume average particle diameter and a 1.33 geometric size distribution.

25. A process in accordance with claim 2 wherein there results a cyan toner with a 9 micron volume average particle diameter and a 1.29 geometric size distribution; a 6.9 micron volume average particle diameter toner with a 1.27 geometric size distribution; a 6.5 micron volume average particle diameter toner with a 1.29 geometric size distribution; a 7.3 micron volume average particle diameter toner with a 1.30 geometric size distribution; or a 9 micron volume average particle diameter toner with a 1.26 geometric size distribution.

* * * * *